United States Patent [19]

Soileau et al.

[11] Patent Number: 4,975,624

[45] Date of Patent: Dec. 4, 1990

[54] SPARK GAP DEVICE PARTICULARLY SUITED FOR A RAPID RESTRIKE CIRCUIT FOR METAL HALIDE LAMPS

[75] Inventors: Trasimond A. Soileau, Flat Rock; Lawrence W. Speaker, Hendersonville, both of N.C.

[73] Assignee: General Electric Company, Schenectady, N.Y.

[21] Appl. No.: 207,357

[22] Filed: Jun. 15, 1988

[51] Int. Cl.[5] ..... H05B 41/14; H05B 37/02

[52] U.S. Cl. ..... 315/289; 315/141; 315/290; 313/325

[58] Field of Search ..... 315/141, 290, 289; 313/325, 118, 140, 141, 142, 131 R

[56] References Cited

U.S. PATENT DOCUMENTS 1,668,615 5/1928 Taubon ..... 315/141

4,723,097 2/1988 Heindl et al. ..... 315/289

*Primary Examiner*—Eugene R. Laroche

*Assistant Examiner*—Ali Neyzari

*Attorney, Agent, or Firm*—John P. McMahon; Stanley C. Corwin; Fred Jacob

[57] ABSTRACT

A spark gap device is disclosed that is particularly suited for a rapid restrike or starting circuit which is employed in sport stadium lighting applications to start or restrike metal halide lamps that have been subjected to a momentary loss of power. The spart gap device comprises two electrodes that are arranged in a parallel side-by-side relationship and spaced apart from each other by a predetermined amount. The spark gap device operates that when a high voltage potential is applied across the electrodes, the generated and reoccuring spark is distributed along the parallel arranged electrodes. The parallel arrangement of electrodes provides for improved life and cooler electrode temperatures as compared to prior art spark gap devices in which the generated and reoccuring spark jumps between the end regions of separated electrodes.

7 Claims, 2 Drawing Sheets

SPARK GAP DEVICE PARTICULARLY SUITED FOR A RAPID RESTRIKE CIRCUIT FOR METAL HALIDE LAMPS

BACKGROUND OF THE INVENTION

This invention relates to rapid restrike circuits for metal halide lamps, and more particularly, to a spark gap device for rapid restrike circuits having an improved electrode arrangement that increases its reliability and operational life.

Standard metal halide lamps having an arc tube disposed therein and containing constituents, typically require a relatively long duration such as 10 to 15 minutes, in which the power may be reapplied to the arc tube to initiate or restrike its arc condition following any power interruption to the lamp which cause the extinction of the arc condition of such a previously operated lamp. Such metal halide lamps suffer a disadvantage in certain lighting systems such as those employed in sports stadiums. For example, if the lighting system of the sports stadium experiences a power outage, it is desired that the initiation or restrike of the arc tube be attempted within a few seconds, rather than 10 to 15 minutes, so that the sporting activity being performed can be resumed within a relatively short time and observed by those people at the stadium and also by those people that may be viewing the event on television.

Metal halide lamps that allow for this restrike condition require a starting or ignition signal of a relatively high voltage and at a relatively high current level from external circuitry in order to initiate a desired ionization condition for the constituents within the arc tube. A related metal halide lamp and associated external circuit are described in U.S. Pat. No. 4,723,097 which is herein incorporated by reference. To accommodate the starting or restrike conditions needed for the related metal halide lamps, the external circuitry commonly employs a spark gap device such as a commonly known spark plug having relatively high voltage and current carrying capabilities. The spark plug has electrodes in which the ends are separated from each other by a predetermined gap to allow a spark to be conducted therebetween during its conductive state. Over a period of operational time of the spark plug, the ends of the electrodes erode, the separation gap becomes larger and the voltage potential necessary to be applied across the electrodes to render the spark plug conductive all increase at a significant rate until the spark plug is rendered inoperative which, in turn, renders the rapid restrike circuit inoperative.

In order to avoid this inoperative state of the rapid restrike circuit, a planned preventive maintenance plan is commonly implemented in which the spark plug is replaced on a periodic basis. It is desired that a more reliable spark gap device having an increased operational life be provided so as to correspondingly increase the reliability of the rapid restrike circuit.

Accordingly, it is an object of the present invention to provide a reliable spark gap device so that the reliability of the rapid restrike circuit used for metal halide lamps may be correspondingly improved.

SUMMARY OF THE INVENTION

This invention is directed to an improved spark gap device for a rapid restrike circuit applicable to metal halide lamps which are both particularly suited for sport stadium lighting applications.

The rapid restrike circuit comprises a transformer having a primary and a secondary winding with the primary winding being adapted to be connected across a source of alternating current (a.c.). The circuit further comprises an energy storage means connected across the secondary windings and a spark gap device. The spark gap device has first and second rod-like electrodes spaced apart from each other in a parallel manner by a predetermined amount. The first electrode is connected to one end of the energy storage means and the second electrode is connected to one end of a primary winding at the input stage of a pulse transformer assembly which winding has its other end connected to the other end of the energy storage means. The pulse transformer assembly has its output stage adapted to be connected to the metal halide lamp.

DETAILED DESCRIPTION OF THE PREFERRED EMBODIMENTS

Figure 1:
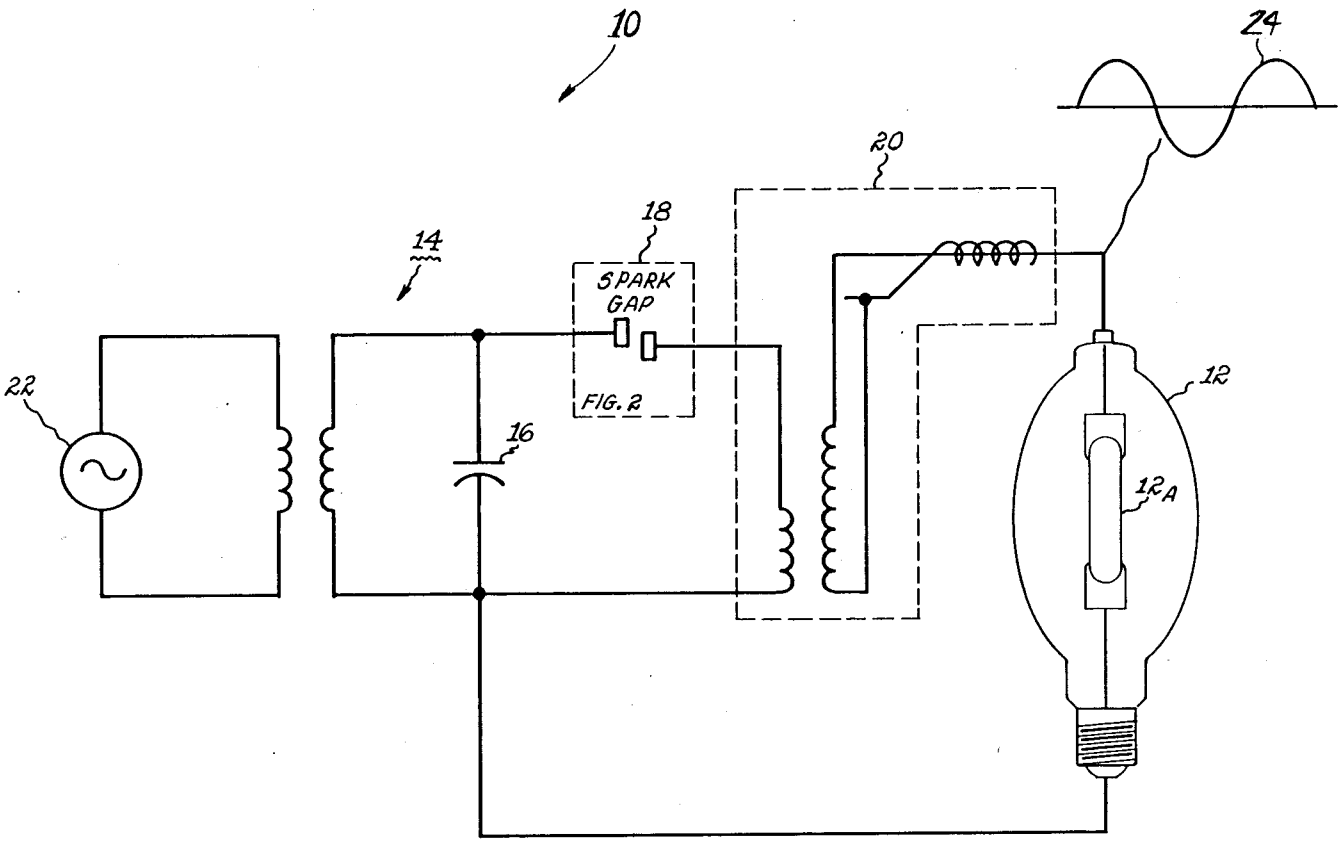
FIG. 1 illustrates a rapid restrike or starting circuit for a metal halide lamp.

FIG. 1 illustrates a circuit 10 which serves both functions of starting and restriking a metal halide lamp 12. The circuitry for supplying the necessary voltage and current conditions during the operative state of the lamp 12 is not shown but may be as described in the previously mentioned U.S. Pat. No. 4,723,097. The lamp 12 has various applications and is particularly suited for sport stadium lighting systems. The rapid restrike or starting circuit 10 comprises a transformer 14, an energy storage means 16, a spark gap device 18, and a pulse transformer assembly 20. The lamp 12 has an arc tube $12_A$ disposed therein and having constituents comprising an inert gas such as xenon or argon, a mercury vapor in the range of about 21 mg to about 165 mg effective to establish an a.c. operating voltage for the arc tube in the range of about 130 to 270 volts, and a halide compound which develops a vapor pressure during the operation of the lamp 12.

The transformer 14 of FIG. 1 has a primary and a secondary winding with the primary winding being adapted to be connected across a source of alternating current (a.c.) 22. The transformer further has means to allow the primary winding to be connected across various sources 22 having different frequencies such as 50 or 60 Hertz, and different voltage amplitudes. The different amplitudes may be 120, 208, 240 or 277 volts (a.c.).

The energy storage means 16 is preferably a 0.05 microfarad capacitor but may have a value in the range from about 0.01 to about 0.1 microfarads. The capacitor 16 is connected across the secondary windings of the transformer 14. One end of the capacitor 16 is also connected to one of the electrodes of the spark gap 18. The other end of the capacitor 16 is connected to one end of a primary winding at the input stage of the pulse transformer assembly 20 and also is adapted to be connected to the base of the metal halide lamp 12. The second electrode of the spark gap 18 is connected to the other end of the primary winding of the pulse transformer assembly 20.

The turns ratio between the primary and secondary windings of the pulse transformer 20 is preferably 20 to 1. The turns ratio is set to a suitable level to raise the voltage to a sufficient value so as to cause ionization of the lamp. The pulse transformer has its output stage connected to the cap of the metal halide lamp 12.

In general, the rapid restrike or starting circuit 10 operates such that the transformer 14 develops a voltage derived from the source 22, across its primary winding that is applied across and begins to charge the capacitor 16. When the voltage across the capacitor 16 builds to and reaches the break-over potential of the spark gap device 18 such as 1,000 to 4,000 volts, the spark gap device 18 conducts causing the energy stored in capacitor 16 to be discharged into the high voltage pulse transformer assembly 20. The transformer 20, being a step-up transformer provides a high frequency high voltage starting signal 24 to the lamp 12 having a peak amplitude of approximately 20,000 to 80,000 volts and a decay time of about 20 to 50 microseconds. This application of the high voltage signal 24 automatically repeats several times during the half-cycle of the applied source 22. The rapid restart circuit 10 supplies the signal 24 during the initial starting of the lamp 12 and also during the restrike conditions after the lamp 12 has experienced any power interruptions as previously described in the "Background" section.

Figure 2:
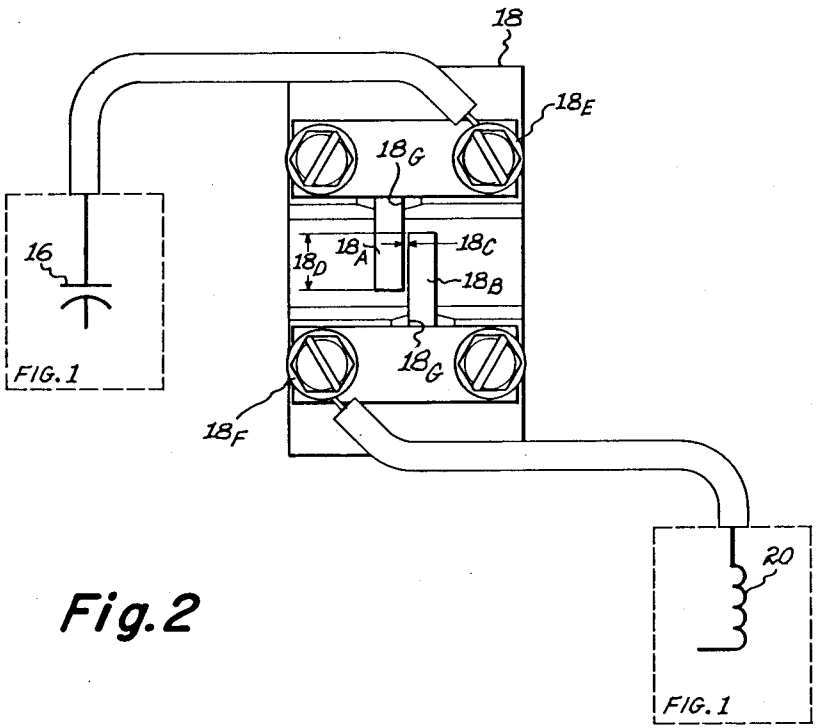
FIG. 2 is an illustration of the spark gap device of the present invention.

The spark gap 18 of circuit 10 is of primary importance to the present invention and may be further described with reference to FIG. 2. The spark gap device 18 has first and second rod-like electrodes $\mathbf{18}_A$ and $\mathbf{18}_B$ spaced apart or gapped from each other, in a parallel manner, by a predetermined amount $\mathbf{18}_C$ in the range of about 0.1 mm to about 1.0 mm. The parallel arranged electrodes $\mathbf{18}_A$ and $\mathbf{18}_B$ face and run along side each other preferably by a distance $\mathbf{18}_D$ covering an amount in the range of about 5.0 to about 15 mm or more depending upon the desired life of the electrodes. The electrodes $\mathbf{18}_A$ and $\mathbf{18}_B$ are electrically interconnected to the circuit arrangement 10 by appropriate means such as screw arrangement clamping devices $\mathbf{18}_E$ and $\mathbf{18}_F$. The electrodes $\mathbf{18}_A$ and $\mathbf{18}_B$ are preferably positioned relative to each other in a parallel manner by the dimensions given by a V-groove arrangement $\mathbf{18}_G$.

The electrodes $\mathbf{18}_A$ and $\mathbf{18}_B$ are preferably of a circular shape and each preferably have a diameter in the range of about 2.0 to about 5.0 mm depending upon the power level desired. The electrodes $\mathbf{18}_A$ and $\mathbf{18}_B$ are of a material selected from the group consisting of tungsten, iron, brass, molybdenum and carbon. The selected material preferably does not form oxides that would interfere with changing the spacing between the electrodes. It is also desirable to select a material of a refractory nature. In one embodiment the electrodes are formed of a two percent (2%) thoriated tungsten material which provide a relative constant breakdown potential regardless of the environment of the spark gap. The constant breakdown potential is meant to represent the voltage potential applied across the electrodes for which the spark condition occurs between the electrodes.

The spark gap device 18 having the parallel arranged electrodes represent significant reliability and operational life increase improvements over prior art spark gap devices such as the commonly used spark plug. The prior art devices of which we are aware are basically made to permit a spark to jump between the ends of two spaced apart or gapped electrodes. The prior devices are designed for relatively low energy levels, whereas, the spark gap device described herein is for energy level of 250 amperes at 2000 volts. The prior art devices while serving their desired function in restrike circuits, disadvantageously over a period of time, allow the ends of the electrodes to erode causing the gap between the electrodes to increase and correspondingly requiring the voltage necessary to provide a breakdown condition between the electrodes to increase at a significant rate until the spark plug becomes rendered inoperative.

The electrodes of the present invention having its parallel configuration improves the life and breakdown voltage of the spark gap device as well as providing cooler electrode temperatures. The life and breakdown voltage are exponentially dependent upon gap electrode temperature in that the hotter the electrodes run, the lower the breakdown voltage and the shorter the electrode life due to oxidation, pitting, and metal transfer. It is desired to keep the breakdown voltage above a minimum value.

The temperature is kept cool in the present invention because the arc moves freely and continuously up and down the gap length thereby not concentrating at any one point, but rather distributing its energy over the entire electrode length area. This is opposed to 'end to end' prior art devices where the arc is made to concentrate therebetween. The freedom of arc movement of the present invention also contributes to electrode life by developing a polishing action of the electrodes. This is accomplished in that an arc tends to take place between the two shortest points therefore any high points along the electrodes are polished away and if any pitting starts to occur the arc avoid that pitting spot until the entire arc area is equally worn. This polishing results in increased electrode life and decreased electrode wear.

In one embodiment, a tungsten material forms a nonconducting volatite oxide which sublimes away harmlessly onto the ceramic holder of the spark gap device 18 leaving the electrodes $\mathbf{18}_A$ and $\mathbf{18}_B$ clean and polished. This oxide formation, due to the aforementioned low operating temperature of the electrodes, forms extremely slow which results in a relatively long electrode life. Also, tungsten being one of the highest melting metals does not pit or melt very easily. The two (2) percent thorium, due to its radioactivity, contributes to stabilizing the breakdown voltage related to the electrodes.

The overall effect of the present invention is to provide a reliable spark gap device, which, in turn, provides for a reliable rapid restrike or starting circuit for a metal halide lamp thereby eliminating any planned preventive maintenance of spark gap replacements as discussed in the "Background" section. In the practice of the present invention, a circuit arrangement having the spark gap device 18, with the features previously described, was successfully and continuously operated for a duration of 8 to 10 hours.

It should now be appreciated that the practice of the present invention provides for a reliable spark gap device, which, in turn, provides for a reliable restrike or starting circuit employed for a metal halide lamp that may experience power interruptions and which are all particularly suited for sports stadium lighting applications.

What we claim as new and desire to secure by Letters Patent of the United States is:

1. A rapid restrike or starting circuit for high intensity discharge lamps comprising;

a transformer having a primary and a secondary winding, with the primary winding being adapted to be connected across a source of alternating current (a.c.);

energy storage means connected across said secondary winding and having one end adapted to be connected to one end of said metal halide lamp;

spark gap device having first and second rod-like solid electrodes spaced apart from each other in a parallel manner so as to face and run along side each other by a predetermined amount, said first electrode being connected to one end of said energy storage means and said second electrode being connected to one end of a primary winding at the input stage of a pulse transformer with the other end of the primary winding being connected to the other end of said energy storage means;

said pulse transformer having its output stage adapted to be connected to the other end of said metal halide lamp.

2. A rapid restrike circuit according to claim 1 wherein said transformer has further means for being adapted to be connected across various sources of alternating current having different frequencies and amplitudes.

3. A rapid restrike circuit according to claim 1 wherein said first and second electrodes are of a circular shape and each have a diameter in the range of about 2.0 to about 5.0 mm.

4. A rapid restrike circuit according to claim 1 wherein said first and second electrodes are of a material selected from the group consisting of tungsten, iron, brass, molybdenum and carbon.

5. A rapid restrike circuit according to claim 1 wherein said first and second electrodes are formed of a two percent (2%) thoriated tungsten material.

6. A rapid restrike circuit according to claim 1 wherein said first and second electrodes are spaced apart from each other by an amount in the range of about 0.1 mm to about 1.0 mm.

7. A rapid restrike circuit according to claim 1 wherein said parallel relationship of first and second electrodes covers a distance in the range of about 5 mm to about 15 mm.

* * * * *